US010286935B2

(12) United States Patent
Zhang et al.

(10) Patent No.: US 10,286,935 B2
(45) Date of Patent: May 14, 2019

(54) CONTACT SYSTEM

(71) Applicant: XI'AN NATIONAL RAILWAY EQUIPMENT RESEARCH OF SIGNAL & COMMUNICATION CO., LTD, Xi'an, Shaanxi (CN)

(72) Inventors: Hui Zhang, Shaanxi (CN); Xiaogang Yang, Shaanxi (CN); Xiaoqi Wang, Shaanxi (CN); Tielu Zhao, Shaanxi (CN); Yuanchou Du, Shaanxi (CN); Deping Li, Shaanxi (CN); Shuzhen Hua, Shaanxi (CN)

(73) Assignee: XI'AN NATIONAL RAILWAY EQUIPMENT RESEARCH OF SIGNAL & COMMUNICATION CO., LTD, Xi'an, Shaanxi (CN)

( * ) Notice: Subject to any disclaimer, the term of this patent is extended or adjusted under 35 U.S.C. 154(b) by 0 days.

(21) Appl. No.: 15/737,754

(22) PCT Filed: Jan. 28, 2016

(86) PCT No.: PCT/CN2016/072480
§ 371 (c)(1),
(2) Date: Dec. 19, 2017

(87) PCT Pub. No.: WO2017/096702
PCT Pub. Date: Jun. 15, 2017

(65) Prior Publication Data

US 2018/0178820 A1 Jun. 28, 2018

(30) Foreign Application Priority Data

Dec. 7, 2015 (CN) ..... 2015 2 1003116 U

(51) Int. Cl.
*B61L 5/10* (2006.01)
*E01B 7/20* (2006.01)

(52) U.S. Cl.
CPC . *B61L 5/10* (2013.01); *E01B 7/20* (2013.01)

(58) Field of Classification Search
CPC ..... B61L 5/10; E01B 7/20
See application file for complete search history.

(56) References Cited

U.S. PATENT DOCUMENTS 3,396,270 A * 8/1968 Kugler ..... B61L 5/06 246/218
5,806,809 A * 9/1998 Danner ..... B61L 5/107 246/220

(Continued)

FOREIGN PATENT DOCUMENTS

CN 2576559 10/2003
CN 201012694 1/2008

(Continued)

*Primary Examiner* — Jason C Smith

(57) ABSTRACT

A contact system employs a swing link (1) to drive set of movable contacts (5) to engage with a left or right set of contacts (24, 25) respectively on two sides thereof, so as to achieve indication of a separate or closure position. Particularly, a drive shaft (2) along with an operating plate (3) and a snap plate (4) on the drive shaft (2) are driven by the swing link (1) to change a motion trajectory of a roller (10) on a movable contact shaft (12), aided by action of a snap-action claw (11) and a tension spring (9), thereby achieving, quick action of set of movable contacts (5), and realizing a contact with or disconnection from set of fixed contacts (6) to achieve indication of the separation or in closure position. The system has a simple structure and a small size, responds quickly and accurately, and is cheap to manufacture, install, and maintain.

4 Claims, 8 Drawing Sheets

(56) References Cited

U.S. PATENT DOCUMENTS

| | | | | |
|---|---|---|---|---|
| 2008/0179467 | A1* | 7/2008 | Wagner | B61L 1/18 246/220 |
| 2010/0025546 | A1* | 2/2010 | Rivas | B61L 5/02 246/410 |
| 2018/0178820 | A1* | 6/2018 | Zhang | E01B 7/20 |
| 2018/0201283 | A1* | 7/2018 | Schalk | B61L 5/10 |
| 2018/0237038 | A1* | 8/2018 | Schafer | B61L 5/02 |
| 2018/0354533 | A1* | 12/2018 | Palozzi | B61L 5/10 |

FOREIGN PATENT DOCUMENTS

| | | |
|---|---|---|
| CN | 201065072 | 5/2008 |
| CN | 201472415 | 5/2010 |
| DE | 4112928 | 11/1991 |
| EP | 2657101 | 10/2013 |

* cited by examiner

CONTACT SYSTEM

TECHNICAL FIELD

The present disclosure belongs to the technical field of the railway signal detection technology, and more particularly to a contact system used in closure detector for checking separate or closure position of the unilateral switch rail.

BACKGROUND

Patent No. ZL200720004154.3 Chinese utility model patents, disclosed a closure detector, which mainly solve the defects existed in previous closure detector, such as large size, poor aseismicity and low security.

However, for closure detector disclosed by this patent, contact or disengagement between the fixed contact and movable contact was achieved through two sets of movable contacts, two sets of fixed contacts, rocker slot, nail, slider and other structures. The overall structure of this closure detector is extremely complicated, so the disclosure of this patent has little contribution for further reducing the size of the closure detector. Otherwise, for the complex structure equipment, you must spend high cost on manufacturing, installation and routine maintenance.

SUMMARY

The purpose of the present invention is to overcome the deficiency of prior art, which is described in the background technology, complex structure and hardly to reduce the volume, high cost to manufacture, install and maintain.

In at least one embodiment, a contact system is provided. The contact system comprising a base 29, a drive spindle 2 penetrating the base 29, a swing link 1 connected to the lower end of the drive spindle 2 by a spline, an operating plate 3 and a snap plate 4 connected to the upper end of the drive spindle 2, a set of movable contacts 5 coupled to said operating plate 3 and said snap plate 4, a set of fixed contacts 6 used with the set of movable contacts 5 to be in separation or in closure position, wherein said set of movable contacts 5 and said set of fixed contacts 6 are fixed to the top face of said base 29; said operating plate 3 and snap plate 4 are fixed on the top face of said base 29 and are surrounded by said set of movable contacts 5 and said set of fixed contacts 6; the operating plate 3 is placed between said snap plate 4 and said base 29, characterized in that said operating plate 3 is connected to the upper end of said drive spindle 2 by a spline; said snap plate 4 is disposed around the upper end of said drive spindle 2 and is placed on the top of said operating plate 3; said set of movable contacts 5 is mounted on the inner end of the movable contact block 13, and the outer end of the movable contact block 13 is provided with a connecting shaft 7 perpendicular to the movable contact block 13, and a connecting hole 27 eccentric to the connecting shaft 7 is provided on one side of the outer end; said movable contact block 13 is coupled to said base 29 through said connecting shaft 7; said movable contact block 13 is connected to the upper end of the movable contact shaft 12 through said connection hole 27, wherein a snap-action pawl 11 cooperating with said snap plate 4 and a roller 10 cooperating with said operating plate 3 are sequentially provided on the side of the lower end of the movable contact shaft 12 in the axial direction of the movable contact shaft 12; said snap-action pawl 11 is located on the same arc surface as the outer surface of said roller 10; said snap plate 4 defines a sliding groove 14 extending in the circumferential direction of said drive spindle 2; a toggle pin 15 is fixedly connected to the top face of said operating plate 3, wherein the toggle pin 15 is inserted into said sliding groove 14; said set of fixed contacts 6 comprises a left set of contacts 24 and a right set of contacts 25; and said left set of contacts 24 and said right set of contacts 25 are provided on the left and right sides of said set of movable contacts 5, respectively.

In one embodiment, the contact system, wherein the outer end face of said operating plate 3 is an arc surface, and the arc surface is divided into three segments of concentric arc surface by the adjacent front bevel 17 and rear bevel 18 toward the end of one side of said roller 10 from the end proximate to said roller 10 to the direction away from said roller 10, and the three segments of concentric arc surface includes an outer segment of arc surface 16, a middle segment of arc surface 19 and an inner segment of arc surface 20 in sequence, and the three segments of concentric arc surface, the front bevel 17 and the rear bevel 18 constitute a rolling surface for rolling said roller 10; the outer end face of said snap plate 4 is an arc surface, which is divided into an outer arc segment 22 oriented toward said roller 10 and an inner arc segment 23 oriented away from said roller 10 by a reverse bevel 21 toward the end of one side of said roller 10; the radius of said outer arc segment 22 is less than that of said outer segment of arc surface 16; the radius of said inner arc segment 23 is equal to the radius of said middle segment of arc surface 19; said reverse bevel 21 is arched towards said inner arc segment 23; and the side of said snap-action pawl 11 that is arched in the same direction as said reverse bevel 21 is an arc-shaped concave surface.

In at least one embodiment, the contact system, wherein the top 28 of said movable contact shaft 12 extends upward through the connection hole 27 and is connected to a tension spring bolt 8 by means of a tension spring 9; the axial direction of the tension spring bolt 8 is parallel to the axial direction of the movable contact shaft 12.

In at least one embodiment, the contact system, wherein said inner arc segment 23 is composed of a large radius segment and a small radius segment 26; the large radius segment is disposed between the reverse bevel 21 and the small radius segment 26; the radius of said large radius segment is greater than that of the small radius segment 26.

The present invention has the advantage of simple structure, small size, rapid and accurate reaction, low cost to manufacture, install and maintain.

A detailed description of the invention is illustrated below according to figures and embodiments.

Figure 1:
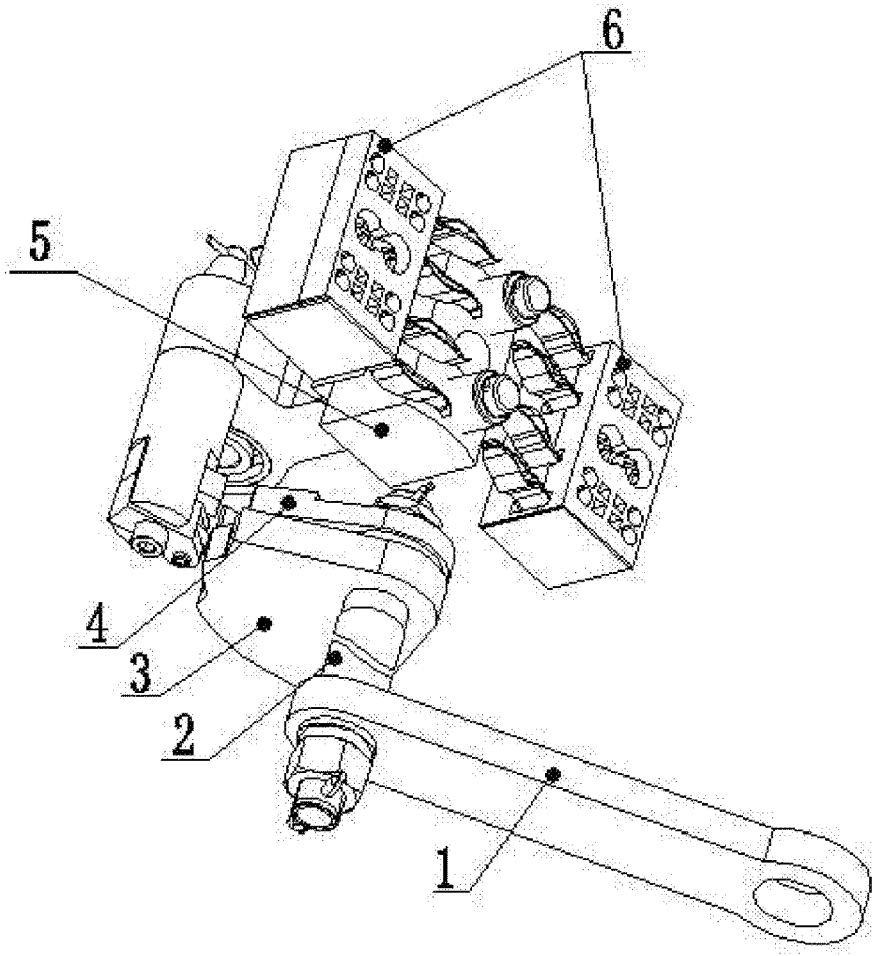
FIG. 1 is a schematic structure of a closure detector.

Brief description of the attached marks in the figures: swing link 1; drive spindle 2; operating plate 3; snap plate 4; set of movable contacts 5; set of fixed contacts 6;

connecting shaft 7; tension spring bolt 8; tension spring 9; roller 10; snap-action pawl 11; movable contact shaft 12; movable contact block 13; sliding groove 14; toggle pin 15; outer segment of arc surface 16; front bevel 17; rear bevel 18; middle segment of arc surface 19; inner segment of arc surface 20; reverse bevel 21; outer arc segment 22; inner arc segment 23; left set of contacts 24; right set of contacts 25; small radius segment 26; connection hole 27; top 28; base 29.

DETAILED DESCRIPTION

Embodiments

In order to realize the purpose of the present invention, that is, to overcome the defects of prior art, such as complex structure, hardly to reduce the volume, high cost to manufacture, install and maintain. In one embodiment of the invention, there provided a contact system, shown as FIG. 1, wherein compromise a drive spindle 2, a swing link 1 connected to one end (this end is lower end looking from the perspective of FIG. 1) of the drive spindle 2 by a spline, an operating plate 3 and a snap plate 4 connected to the other end (the other end is upper end looking from the perspective of FIG. 1) of the drive spindle 2, a set of movable contacts 5 coupled to the operating plate 3 and the snap plate 4, a set of fixed contacts 6 used with the set of movable contacts 5 to be in separation or in closure position; when compared with prior art, the main improvement is, the operating plate 3 is connected to one end (this end is upper end looking from the perspective of this Figure) of the drive spindle 2 by a spline, the snap plate 4 is disposed around the other end (the other end is upper end looking from the perspective of this Figure) of the drive spindle 2 and is placed on the top of the operating plate 3.

Figure 3:
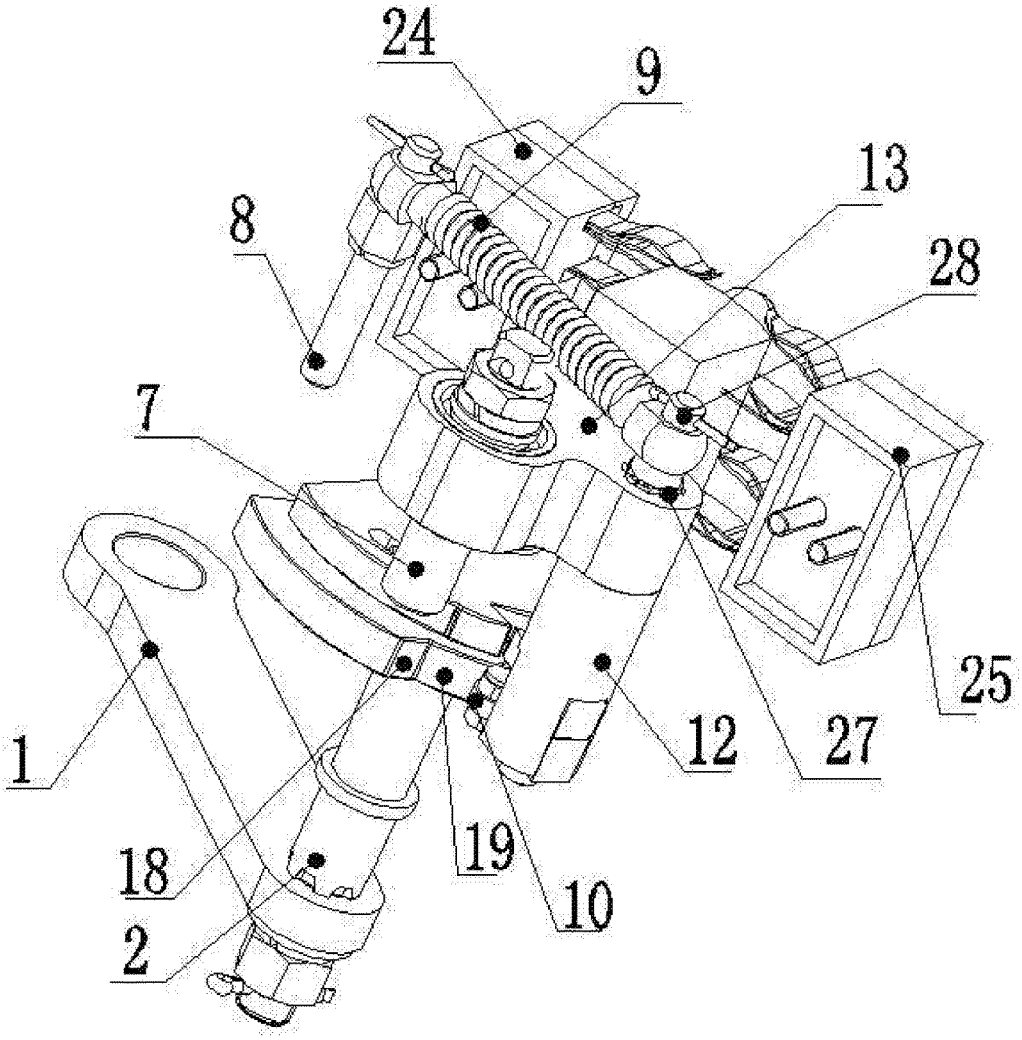
FIG. 3 is another schematic structure of a closure detector.
Figure 6:
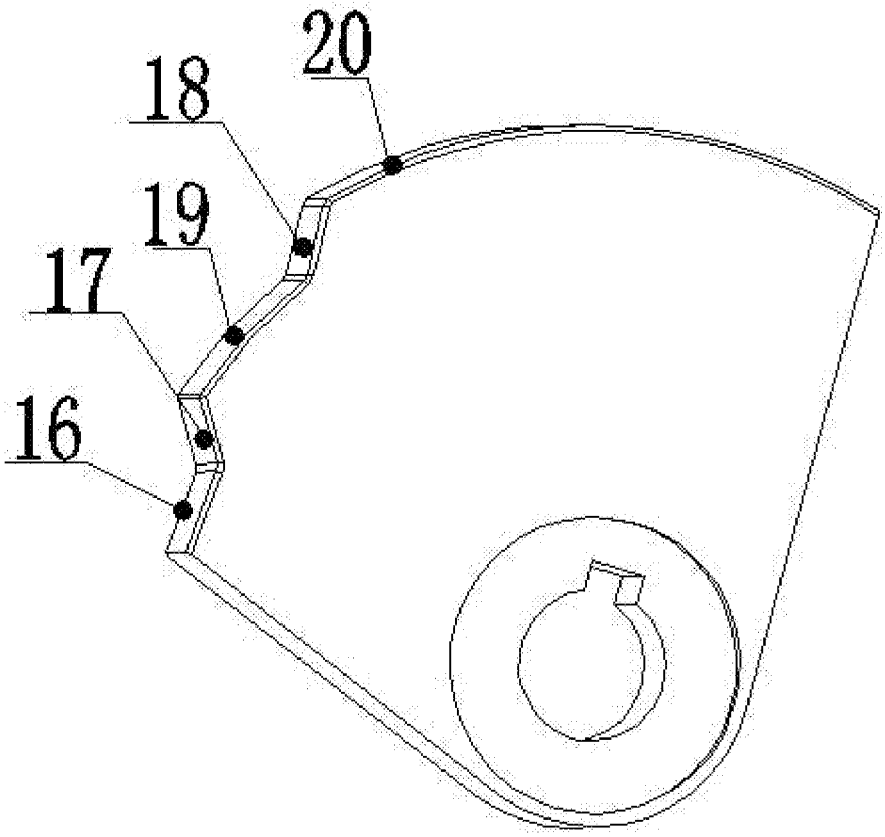
FIG. 6 is a schematic structure of an operating plate.

Combined with FIG. 6, the outer end face of the operating plate 3 is an arc surface, and the arc surface is divided into three segments of concentric arc surface by an adjacent front bevel 17 and a rear bevel 18 toward the end of one side of roller 10 (as shown in FIG. 3) from the end proximate to the roller 10 to the direction away from the roller 10, and the three segments of concentric arc surface includes an outer segment of arc surface 16, a middle segment of arc surface 19 and an inner segment of arc surface 20 in sequence, and the three segments of concentric arc surface, the front bevel 17 and the rear bevel 18 constitute a rolling surface for rolling the roller 10.

Figure 4:
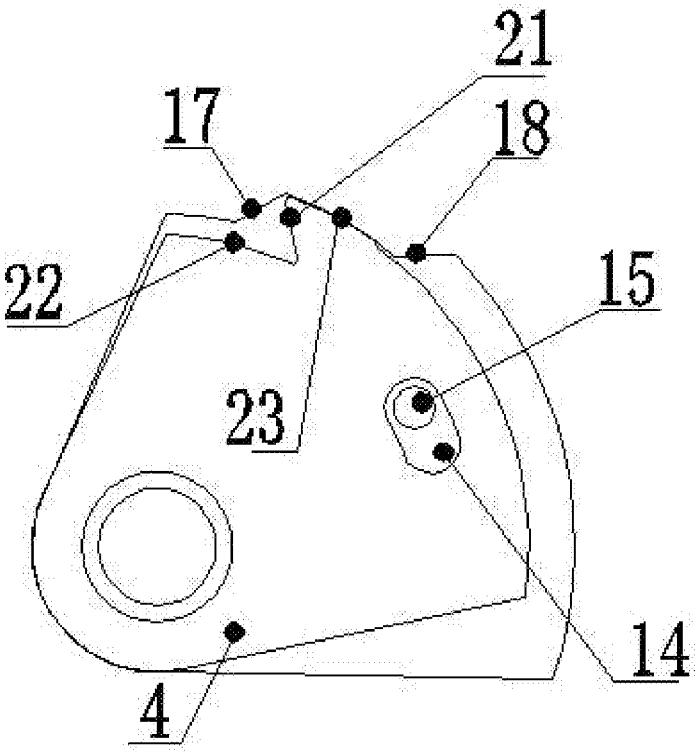
FIG. 4 is a schematic structure of an operating plate and a snap plate.

With reference to FIG. 4, the snap plate 4 is shown, the outer end face of the snap plate 4 is an arc surface, the end of which towards one side of the roller 10 is divided into an outer arc segment 22 oriented toward the roller 10 and an inner arc segment 23 oriented away from the roller 10 by a reverse bevel 21 (as shown in FIG. 3); the radius of the outer arc segment 22 is less than that of the outer segment of arc surface 16; the radius of the inner arc segment 23 is equal to the radius of the middle segment of arc surface 19; the reverse bevel 21 is arched towards the inner arc segment 23; and the side of the snap-action pawl 11 that is arched in the same direction as the reverse bevel 21 is an arc-shaped concave surface.

Figure 2:
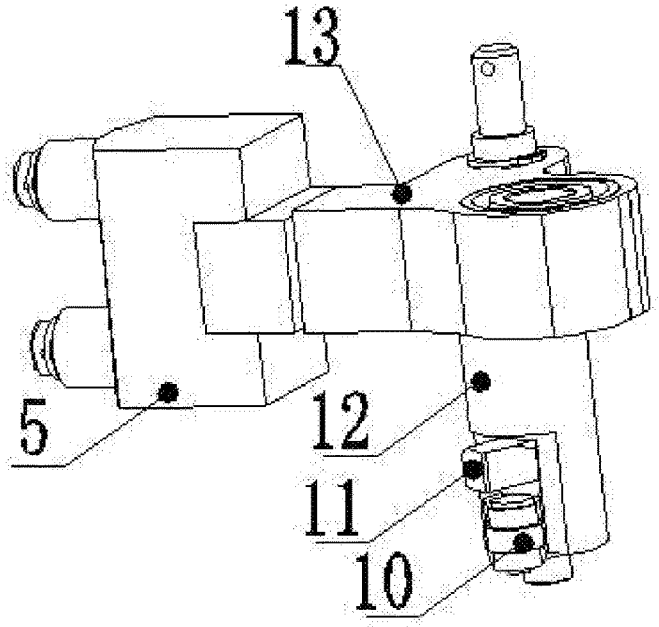
FIG. 2 is a schematic setting of the member in the set of movable contacts.

With reference to FIG. 2, the set of movable contacts 5 is provided that mounted on the end (This is the left end of the movable contact block 13 of the view of FIG. 2) of the movable contact block 13, the other end of the movable contact block 13 (that is, the right end of the movable contact block 13 in the perspective of FIG. 2) is provided with a connecting shaft 7 perpendicular to it (as shown in FIG. 3).

Figure 9:
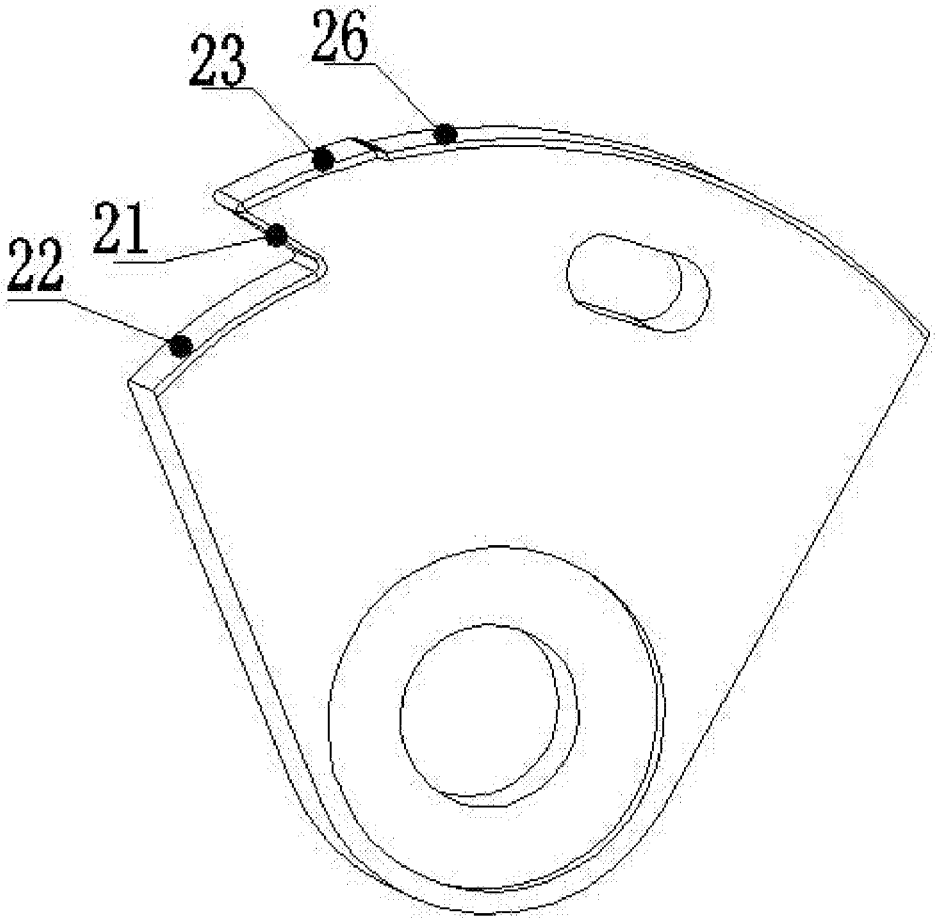
FIG. 9 is a schematic structure of a snap plate.

On one side of this end portion there installs a connecting hole 27 eccentric to the connecting shaft 7, and the connecting hole 27 is connected to one end of a movable contact shaft 12. From the perspective of FIG. 3, the top 28 of the movable contact shaft 12 is mounted on the connecting hole 27 so as to realize the connection between the movable contact shaft 12 and the movable contact block 13. It can be easily found that, the top 28 of the movable contact shaft 12 (certainly, in practice, the top 28 may be a bolt mounted on the connecting hole 27, the bolt and the movable contact shaft 12 are respectively mounted on the openings on both sides of the connecting hole 27) extends upward through the connection hole 27 and is connected to a tension spring bolt 8 by means of a tension spring 9; the axial direction of the tension spring bolt 8 is parallel to the axial direction of the movable contact shaft 12. On the side face of the other end of the movable contact shaft 12, i.e., on the side face of the lower end of the movable contact shaft 12 in the perspective of FIG. 3, wherein a snap-action pawl 11 cooperating with the snap plate 4 and a roller 10 cooperating with the operating plate 3 are sequentially arranged in the axial direction of the movable contact shaft 12 from the lower end to the other end. It can be clearly seen from FIG. 2 that the outer surface of the snap-action pawl 11 and the roller 10 is located on the same arc surface, it means, the movable contact shaft 12 is equidistant from the snap-action pawl 11 and the farther end of the roller 10. Combined with that, the radius of the front bevel 17 is larger than that of the middle segment of arc surface 19 (as shown in FIG. 6), it is easy to understand that when the roller 10 contacts with the highest point of the outer arc surface 16, meanwhile, the snap-action pawl 11 is in contact with the outer surface of the reverse bevel 21 namely the outer arc segment 22 shown in FIG. 9, under the action of the extension spring 9, in addition to the guiding action of the outer arc segment 22, the snap-action pawl 11 and the roller 10 rapidly move toward the rear bevel 18.

It can be seen from FIG. 4 that the snap plate 4 is provided with a sliding groove 14 extending in the circumferential direction of the drive spindle 2. A toggle pin 15 is fixedly connected on the top surface of the operating plate 3, and the top of the toggle pin 15 is inserted into the sliding groove 14, there resulting in non-synchronous displacement between the snap plate 4 and the operating plate 3, furthermore, the snap plate 4 is driven to move by the toggle pin 15 fixed on the top surface of the operating plate 3 only after the operating plate 3 has displaced for a period of time.

It can be clearly seen from FIG. 6 that there is a rolling surface for rolling the roller 10 formed by the outer segment of arc surface 16, the front bevel 17, the rear bevel 18, the middle segment of arc surface 19 and the inner segment of arc surface 20. In other words, when the starting piece 3 is driven to rotate by the drive spindle 2, the roller 10 which is fixed on the movable contact shaft 12 starts rolling along the rolling surface from the outer segment of arc surface 16, passes through the front bevel 17, the middle segment of arc surface 19 and the rear bevel 18 in sequence, and then rolls in the direction to the inner segment of arc surface 20.

In order to ensure the reliability of the operation, in the present embodiment, the axial direction of the set of movable contacts 5 is perpendicular to the axial direction of the movable contact shaft 12.

Figure 8:
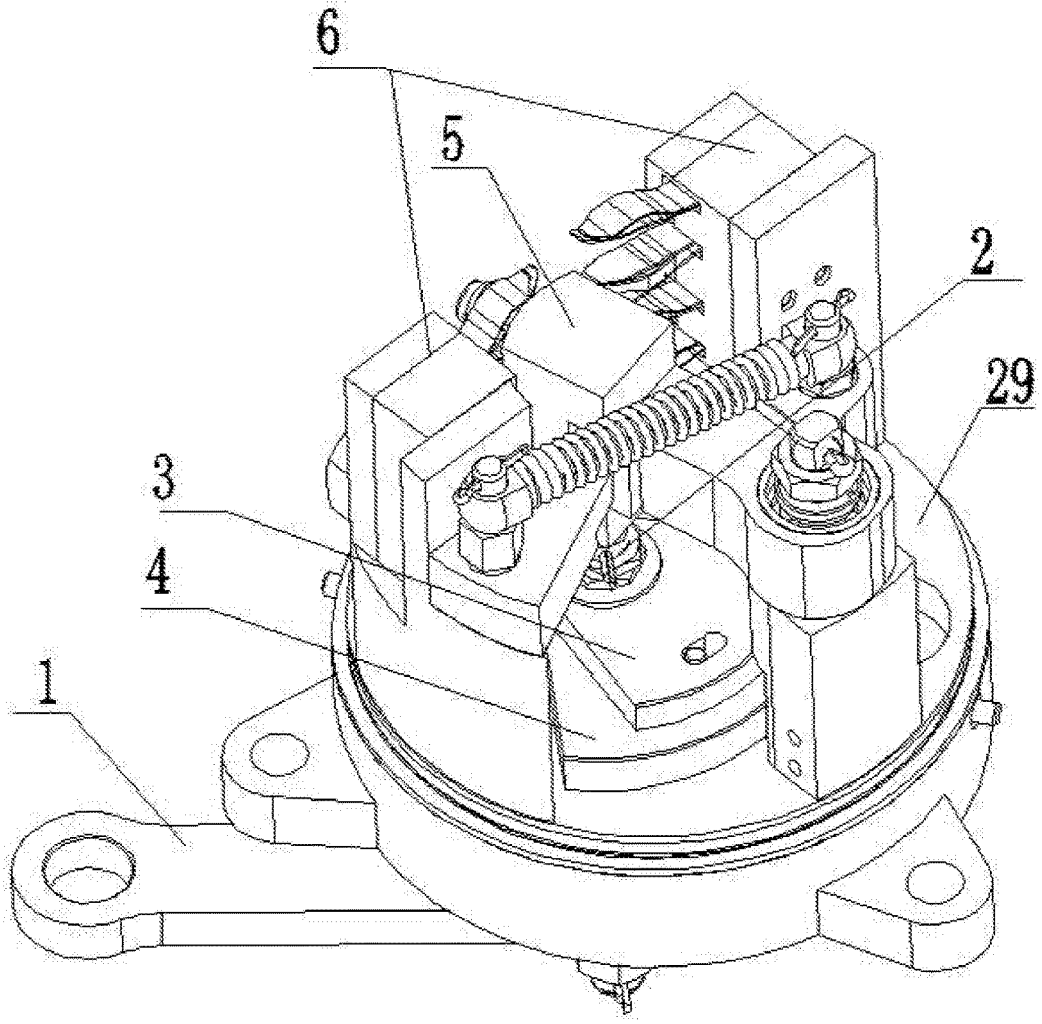
FIG. 8 is a schematic of a contact system mounted a base.

While the set of fixed contacts 6 shown in FIG. 3 includes a left set of contacts 24 and right set of contacts 25, the left contact group 24 and the right contact group 25 are respectively disposed on the left and right side of the set of movable contacts 5. Such structure achieves single-pole double-throw function similar to that of a knife, that is, separation or closure position of a unilateral switch rail can be realized. FIG. 8 shows the contact system provided with the base 29; the drive spindle 2, the operating plate 3, the snap plate 4, the set of movable contacts 5 are all mounted on the base 29.

Figure 5:
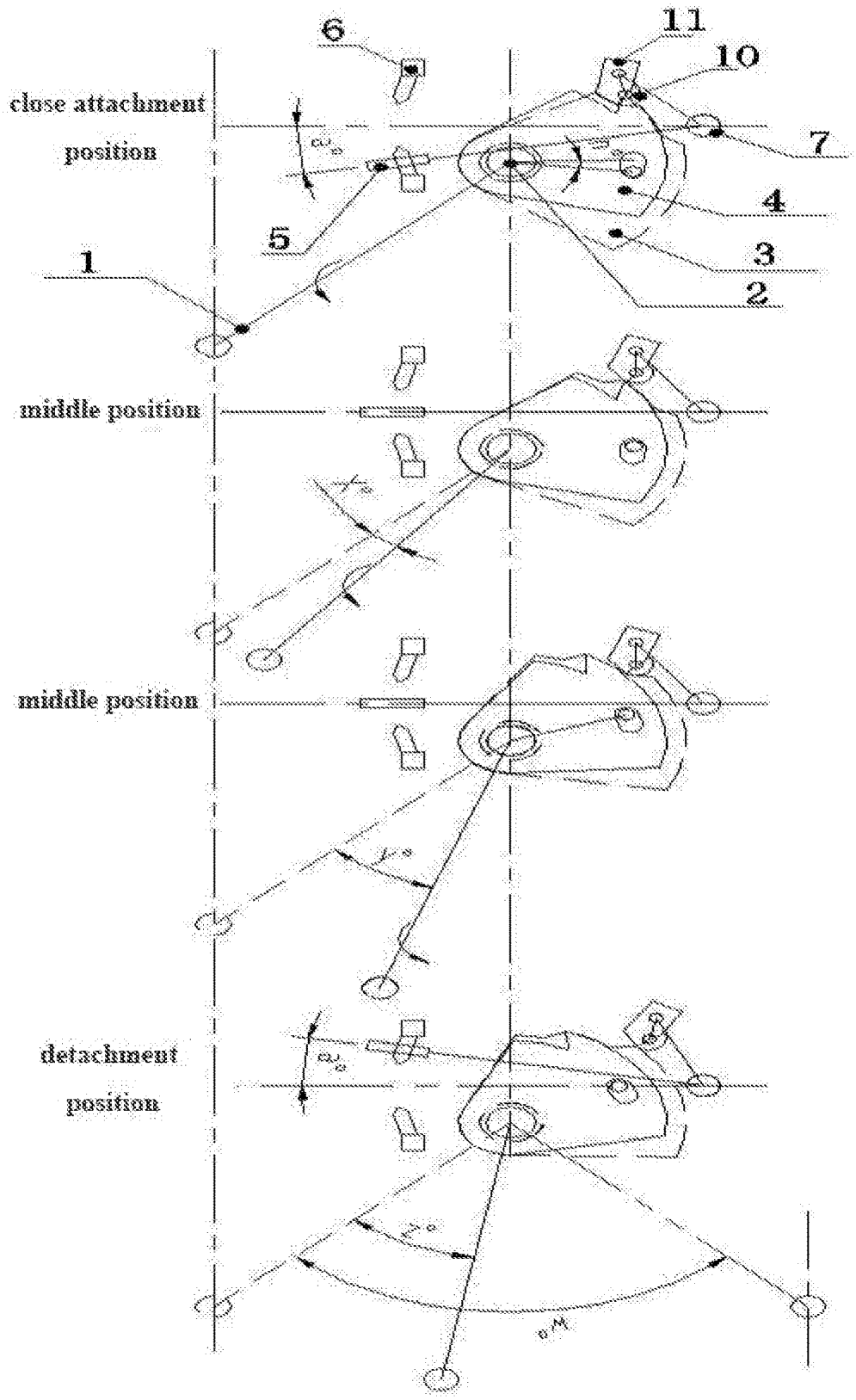
FIG. 5 is a schematic process of set of movable contacts switching from closure position to separation position.

The working procedures of the close checker provided by the above embodiments are described as follows:

FIG. 5 is a schematic process of set of movable contacts 5 switching from closure position to separation position (the position of set of movable contacts and set of fixed contacts changes from contact with each other to away from each other or non-contact). At first, the set of movable contacts 5 is in closure position, then the swing link 1 drives the drive spindle 2 and the operating plate 3 to rotate anticlockwise; the roller 10 in the set of movable contacts 5 rolls along the front bevel 17 shown in FIG. 10 (or FIG. 6), and also drives the set of movable contacts 5 to rotate clockwise about the connecting shaft 7. During the clockwise rotation of the set of movable contacts 5, the snap-action claw 11 immediately drives the snap plate 4 to rotate clockwise about the drive spindle 2 when the snap-action pawl 11 interferes with the reverse bevel 21 of the snap plate 4 to ensure that the set of movable contacts 5 of the wheel can smoothly climb on the front bevel 17. When the roller 10 climbs on the front bevel 17 that is at the intersection of the front bevel 17 and the middle segment of arc surface 19, the snap plate 4 rotates clockwise about the drive spindle 2 by n° relative to the operating plate 3, and the swing link swings counterclockwise by x°, the set of movable contacts rotates clockwise by a°. At this moment, the set of movable contacts 5 is switched to the middle position (the set of movable contacts 5 is always in the middle position when the roller rolls on the middle segment of arc surface 19).

When the set of movable contacts 5 is in the middle position, the swing link 1 continues to drive the drive spindle 2 and the operating plate 3 rotates anticlockwise, the roller in the set of movable contacts 5 rolls along the middle segment of arc surface 19 and drives the set of movable contacts 5 to rotate clockwise about the connecting shaft 7; when the roller climbs on the rear bevel 18, i.e., at the intersection of the inner segment of arc surface 20, the swing link 1 swings counterclockwise by z° relative to its initial position, and the movable contact set 5 clockwise rotation a°; at this moment the set of movable contacts 5 switch to the separation position. At this point, the set of movable contacts 5 complete the switching from closure position to separation position.

Figure 7:
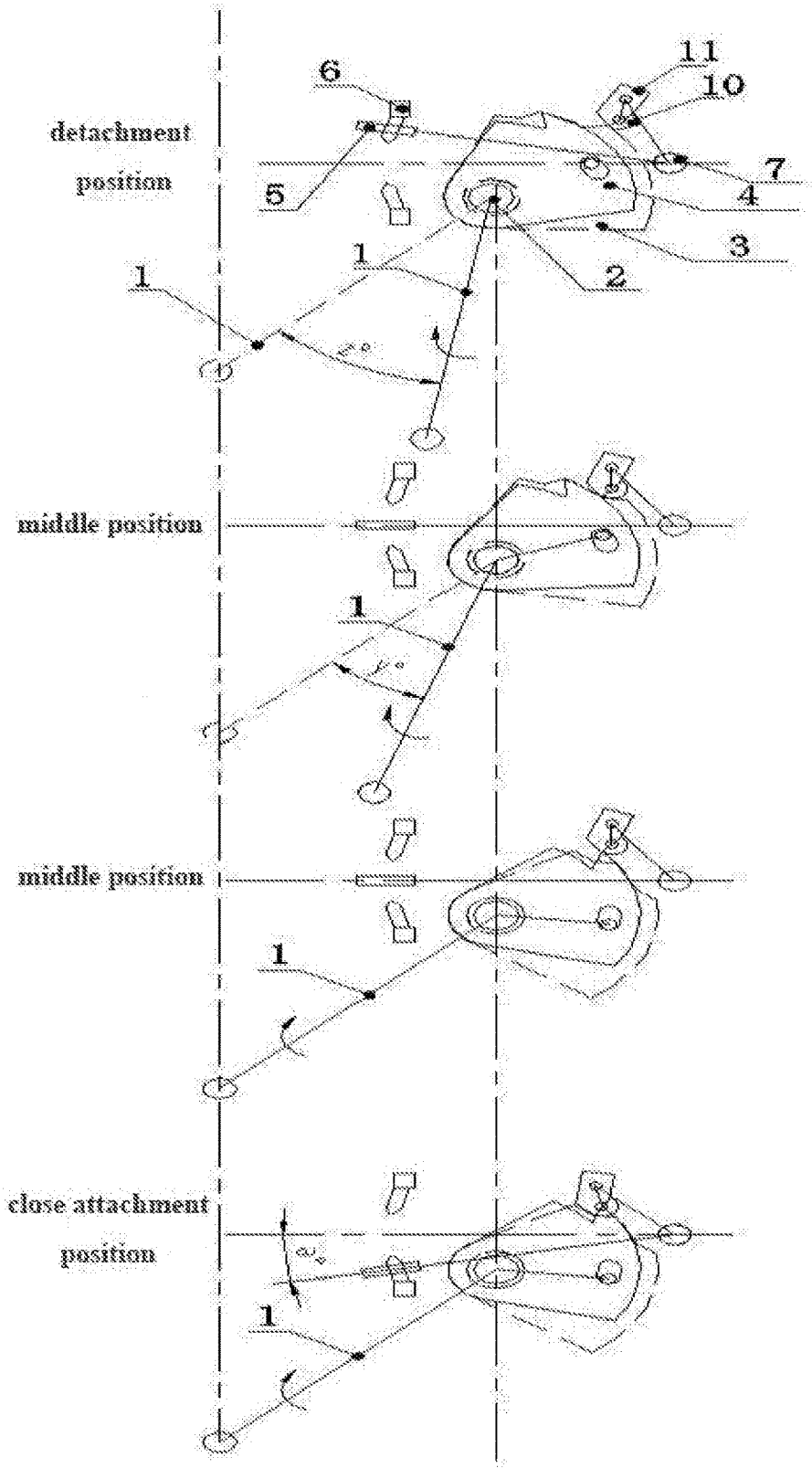
FIG. 7 is a schematic process of set of movable contacts switching from separation position to closure position.

What is shown in FIG. 7 is a schematic process of set of movable contacts 5 switching from separation position to closure position. At first, the set of movable contacts 5 in separation position, when the swinging link 1 drives the drive spindle 2 and the operating plate 3 to rotate anticlockwise, the roller 10 of set of movable contacts 5 is actuated rolling along the inner segment of arc surface 20 by the tension spring, at the same time, turns the set of movable contacts to rotate around the connecting shaft 7 anticlockwise. When the roller 10 rolls down the rear bevel 18, that is, it is tangent to the rear bevel 18 and the middle segment of arc surface 19 at the same time, the set of movable contacts 5 switch to the middle position (the set of movable contacts 5 is always in the middle position when the roller 10 rolls on the middle segment of arc surface 19). The swing link 1 continues to drive the drive spindle 2 and the operating plate 3 to rotate clockwise, the roller 10 in the set of movable contacts 5 rolls along the middle segment of arc surface 19; when the top of the snap-action pawl 11 and the inner arc segment 23 of the snap plate 4 contact with each other, the snap-action claw 11 drives the snap plate 4 to rotate anticlockwise about the drive spindle 2. When the snap plate 4 rotates about the drive spindle 2 counterclockwise by n° relative to the operating plate 3, that is, when the top of snap-action pawl 11 and the top of the snap plate 4 are at the critical position, the roller 10 is in a dangling position. At this moment, the snap-action claw 11 of set of movable contacts 5 falls from the critical position quickly under the action of the tension spring, that is, the set of movable contacts 5 is rapidly rotated anticlockwise by a° to switch to the closure position.

Last thing to emphasize is that, the movable contact shaft 12 is formed integrally with movable contact block 13 in all of the above embodiments; thereby contribute to preferable integrality, excellent stiffness, prominent intensity and durability.

The invention claimed is:

1. A contact system comprising a base (29), a drive spindle (2) penetrating the base (29), a swing link (1) connected to the lower end of the drive spindle (2) by a spline, an operating plate (3) and a snap plate (4) connected to the upper end of the drive spindle (2), a set of movable contacts (5) coupled to said operating plate (3) and said snap plate (4), a set of fixed contacts (6) used with the set of movable contacts (5) to be in separation or in closure position, wherein said set of movable contacts (5) and said set of fixed contacts (6) are fixed to the top face of said base (29);

said operating plate (3) and snap plate (4) are fixed on the top face of said base (29) and are surrounded by said set of movable contacts (5) and said set of fixed contacts (6);

the operating plate (3) is placed between said snap plate (4) and said base (29), characterized in that said operating plate (3) is connected to the upper end of said drive spindle (2) by a spline;

said snap plate (4) is disposed around the upper end of said drive spindle (2) and is placed on the top of said operating plate (3);

said set of movable contacts (5) is mounted on the inner end of the movable contact block (13), and the outer end of the movable contact block (13) is provided with a connecting shaft (7) perpendicular to the movable contact block (13), and a connecting hole (27) eccentric to the connecting shaft (7) is provided on one side of the outer end;

said movable contact block (13) is coupled to said base (29) through said connecting shaft (7);

said movable contact block (13) is connected to the upper end of the movable contact shaft (12) through said connection hole (27), wherein a snap-action pawl (11) cooperating with said snap plate (4) and a roller (10) cooperating with said operating plate (3) are sequentially provided on the side of the lower end of the movable contact shaft (12) in the axial direction of the movable contact shaft (12); said snap-action pawl (11) is located on the same arc surface as the outer surface of said roller (10);

said snap plate (4) defines a sliding groove (14) extending in the circumferential direction of said drive spindle (2);

a toggle pin (15) is fixedly connected to the top face of said operating plate (3), wherein the toggle pin (15) is inserted into said sliding groove (14);

said set of fixed contacts (6) comprises a left set of contacts (24) and a right set of contacts (25); and said left set of contacts (24) and said right set of contacts (25) are provided on the left and right sides of said set of movable contacts (5), respectively.

2. The contact system of claim 1, wherein the outer end face of said operating plate (3) is an arc surface, and the arc surface is divided into three segments of concentric arc surface by the adjacent front bevel (17) and rear bevel (18) toward the end of one side of said roller (10) from the end proximate to said roller (10) to the direction away from said roller (10), and the three segments of concentric arc surface includes an outer segment of arc surface (16), a middle segment of arc surface (19) and an inner segment of arc surface (20) in sequence, and the three segments of concentric arc surface, the front bevel (17) and the rear bevel (18) constitute a rolling surface for rolling said roller (10);

the outer end face of said snap plate (4) is an arc surface, which is divided into an outer arc segment (22) oriented toward said roller (10) and an inner arc segment (23) oriented away from said roller (10) by a reverse bevel (21) toward the end of one side of said roller (10);

the radius of said outer arc segment (22) is less than that of said outer segment of arc surface (16);

the radius of said inner arc segment (23) is equal to the radius of said middle segment of arc surface (19);

said reverse bevel (21) is arched towards said inner arc segment (23); and the side of said snap-action pawl (11) that is arched in the same direction as said reverse bevel (21) is an arc-shaped concave surface.

3. The contact system of claim 2, wherein the top (28) of said movable contact shaft (12) extends upward through the connection hole (27) and is connected to a tension spring bolt (8) by means of a tension spring (9); the axial direction of the tension spring bolt (8) is parallel to the axial direction of the movable contact shaft (12).

4. The contact system of claim 2, wherein said inner arc segment (23) is composed of a large radius segment and a small radius segment (26); the large radius segment is disposed between the reverse bevel (21) and the small radius segment (26);

the radius of said large radius segment is greater than that of the small radius segment (26).

* * * * *